US009756967B2

(12) United States Patent
Lehovetzki et al.

(10) Patent No.: US 9,756,967 B2
(45) Date of Patent: Sep. 12, 2017

(54) PORTABLE WORK SURFACE

(71) Applicant: Stanley Middle East FZE, Dubai (AE)

(72) Inventors: Axel Lehovetzki, Les Lilas (FR); Thomas Vallette, Bures sue Yvette (FR); Norbert Feraud, Versailles (FR)

(73) Assignee: THE STANLEY WORKS ISRAEL LTD (IL)

( * ) Notice: Subject to any disclaimer, the term of this patent is extended or adjusted under 35 U.S.C. 154(b) by 0 days.

(21) Appl. No.: 15/042,903

(22) Filed: Feb. 12, 2016

(65) Prior Publication Data

US 2016/0235225 A1 Aug. 18, 2016

(30) Foreign Application Priority Data

Feb. 13, 2015 (GB) ..... 1502487.0
Feb. 13, 2015 (GB) ..... 1502488.8

(51) Int. Cl.
*B65D 30/00* (2006.01)
*A47G 9/06* (2006.01)
(Continued)

(52) U.S. Cl.
CPC ..... *A47G 9/062* (2013.01); *A45C 9/00* (2013.01); *A45C 13/1046* (2013.01); *A45C 2200/15* (2013.01)

(58) Field of Classification Search
CPC . A45C 2007/0004; A45C 7/0077; A45C 9/00; A45C 13/1046; A47G 9/062
(Continued)

(56) References Cited

U.S. PATENT DOCUMENTS 268,542 A * 12/1882 Ruckert ..... B65D 5/4287 229/154
5,016,813 A * 5/1991 Simons ..... B65D 5/4287 229/189
(Continued)

FOREIGN PATENT DOCUMENTS

EP 0 578 247 A1 * 1/1994
GB 2363708 A 1/2002

OTHER PUBLICATIONS

Brigitta Zetzsche, European Search Report, dated Jul. 29, 2016, The Hague.
(Continued)

*Primary Examiner* — Jes F Pascua
(74) *Attorney, Agent, or Firm* — Carl E. Myers

(57) ABSTRACT

A portable work surface is convertible between mat and bag configurations, and includes a body with a central portion and a surrounding peripheral portion, with a cord threaded at least part way around the peripheral portion. The central and peripheral portions are configurable to define a substantially planar mat configuration. The cord is operable to fold the peripheral portion about the central portion to define a bag configuration where the central portion defines a bag base and the peripheral portion defines a bag wall. The peripheral portion comprises rigid members spanning the distance of the bag wall substantially between the central portion and the cord. In an embodiment, a cover may be hingedly connected to the body, foldable to straddle the peripheral portion in the bag configuration, and configurable to protrude proud of the planar mat configuration of the central portion and the peripheral portion.

16 Claims, 9 Drawing Sheets

(51) Int. Cl.
*A45C 9/00* (2006.01)
*A45C 13/10* (2006.01)

(58) Field of Classification Search
USPC ..... 383/4, 72, 75, 76, 119, 120; 5/417, 419, 5/420, 418
See application file for complete search history.

(56) References Cited

U.S. PATENT DOCUMENTS 5,518,313 A * 5/1996 McAdam ..... B65D 65/22 229/87.19
5,693,398 A 12/1997 Granger
7,188,713 B1 * 3/2007 Espar ..... A45C 7/0095 190/107
7,594,754 B2 * 9/2009 Costello ..... B65F 1/00 383/117
7,597,209 B2 * 10/2009 Rothschild ..... A45C 7/0036 220/23.87
7,845,508 B2 * 12/2010 Rothschild ..... A45C 7/0054 190/107
7,967,508 B2 * 6/2011 Costello ..... B65F 1/00 363/119
9,084,459 B2 * 7/2015 Fazackerley ..... A45C 9/00
9,428,931 B2 * 8/2016 Samaripa ..... E04H 15/30
9,480,317 B2 * 11/2016 Rothschild ..... A45C 7/0036
2006/0169691 A1 8/2006 Rothschild et al.
2006/0177154 A1 * 8/2006 Morrissey ..... A45F 4/06 383/4
2015/0122196 A1 * 5/2015 Liu ..... A01K 1/0254 119/497
2015/0296941 A1 * 10/2015 Liu ..... A01K 1/0254 190/107

OTHER PUBLICATIONS

Annex to the European Search Report on European Patent Application No. EP 16 15 5360, dated Jul. 22, 2016.
European Search Report dated Jul. 22, 2016.

* cited by examiner

PORTABLE WORK SURFACE

CROSS-REFERENCE TO RELATED APPLICATION

This application claims priority from GB Patent Application Nos. 1502487.0 and 1502488.8, both of which were filed Feb. 13, 2015, the disclosures of which are incorporated herein by reference in their entireties.

FIELD OF THE INVENTION

The present invention relates to a portable work surface comprising a work mat that may be converted between a mat configuration and a bag configuration.

BACKGROUND OF THE INVENTION

Patent publication EP 0 578 247 A1 discloses an example of a convertible mat which may be converted between a mat configuration and a bag configuration. Such convertible mats may be used, for example, as a picnic bag to transport items such plates, cutlery, or food. The convertible mat may be folded out into a continuous, flat surface for the picnic. A convertible mat may be used to transport items for infants, such as nappies, bottles, or food. The convertible mat may be folded out into a continuous, flat surface for a sleeping infant or changing a nappy. A convertible mat may be used to transport items to the beach and used as a beach mat. The convertible mat avoids using a separate bag and mat.

Hitherto use of known convertible mats, like the one disclosed by publication EP 0 578 247 A1, have typically been in the domestic or leisure environment. The present disclosure provides a portable work surface comprising a work mat convertible between a mat configuration and a bag configuration. The mat may include: a body with a central portion and a peripheral portion surrounding the central portion; and a gathering means with a cord threaded at least part way around the peripheral portion. In an embodiment, the mat may include a cover hingedly connected to the body. In an embodiment, the central portion and the peripheral portion are configurable to define a substantially planar mat configuration, wherein the peripheral portion is foldable about the central portion, wherein the cord is operable by the gathering means to fold the peripheral portion about the central portion to define a bag configuration. In an embodiment, in the bag configuration the central portion defines a bag base and the peripheral portion defines a bag wall, and wherein the peripheral portion comprises rigid members spanning the distance of the bag wall substantially between the central portion and the cord. The portable work surface is adaptable to all manner of work environments. It may be partially rested up against a wall or other obstacle if this is required due to lack of space or an irregular work environment. To perform this function, the mat may be deliberately partially folded, by operation of the gathering means, so that a part of the peripheral portion is raised up by the cord. The peripheral portion of the body, midway between mat and bag configuration, may maintain a bowl-like shape due to its rigidity. Advantageously, the mat may store tools and accessories and collect lose parts and debris without them rolling away. When work is complete, the mat may be converted into a bag configuration for swiftly transporting the tools, accessories, lose parts and debris away for storage or disposal.

In an embodiment, the rigid members are arranged to promote concertina folding of the peripheral portion about the central portion in the bag configuration. This is a neat and compact way of condensing the peripheral portion into a bag wall.

In an embodiment, each rigid member comprises a substantially straight edge adjacent the central portion. The straight edges may help to steady the rigid members on the ground, and with respect to the body portion, when the peripheral portion is partially folded, or folded into the bag configuration. In an embodiment, each rigid member comprises a triangular planar member.

In an embodiment, the mat comprises a cover hingedly connected to the body. In some embodiments, the cover is foldable to straddle the peripheral portion in the bag configuration, and wherein the cover is configurable to protrude proud of the planar mat configuration of the central portion and the peripheral portion. The cover may be used to close the contents of the mat when it is in a bag configuration. When the mat is in the mat configuration, the cover may be stood up in a way that adds a vertical dimension to the planar central and peripheral portions of the mat's body. Advantageously, the cover, stood in this manner, may help attract attention to the presence of the mat on the ground or a surface in a work environment. The work surface provided by the mat is more likely to be respected by those in view of the cover. The users of the mat, their purpose and/or their contact details may be identified by the cover. Users of the mat may undertake their work within the confines of the work surface it provides and in relative peace. People are less likely to tamper with the mat. In an embodiment, when work is complete, the mat may be converted into a bag configuration for storing tools, accessories, lose parts and debris and swiftly transporting them away for storage or disposal.

In an embodiment, the cover comprises an inner panel and an outer panel hingedly connected to the inner panel and wherein the outer panel is pivotable to adopt a divergent orientation with respect to the inner panel whereat the outer panel is arranged to support the cover proud of the planar mat configuration of the central portion and the peripheral portion. This divergent, or tent-like, orientation provides a simple means of providing a footprint upon which the cover may be stood.

The cover may comprise a coupling member operable to couple the outer panel in the divergent orientation with respect to the inner panel. The coupling member may help to steady the cover when it is stood up.

In an embodiment, the body comprises a peripheral edge around the peripheral portion and wherein the peripheral edge may comprise fluorescent and/or reflective material. This may help attract additional attention to the presence of the mat and the work surface provided by the mat. In an embodiment wherein a cover hingedly connects to the body substantially at the peripheral edge, the cover may be stood outside the peripheral edge, and in doing so may avoid occupying the work surface provided by the mat.

The body may have a mixture of straight and curved sides. In an embodiment, the body is a substantially regular polygonal body or circular body. Symmetry in the shape of the body may improve opening and closing.

In an embodiment, in the bag configuration, the central portion defines a bag base and the peripheral portion defines a bag wall. The body may have an increased cross-sectional thickness around the circumference of the peripheral portion which forms a central sunken zone to collect and retain lose parts and debris fallen on the mat. The central portion may comprise a rigid member to encourage the peripheral portion to fold about the central portion. In an embodiment, the peripheral portion comprises rigid inserts arranged to promote concertina folding of the peripheral portion about the central portion in the bag configuration. The body may comprise a resilient or cushioning material. The advantages of these features are described in the following description.

In an embodiment, the body comprises weakened regions arranged to facilitate folding the peripheral portion about the central portion during a transition between the mat configuration and the bag configuration. The weakened regions help to reliably and swiftly fold the mat from bag configuration to mat configuration and back again.

BRIEF DESCRIPTION OF THE DRAWINGS

Details of the present invention shall be described, by way of non-limiting example, with reference to the drawings of which.

DETAILED DESCRIPTION OF THE INVENTION

Figure 6:
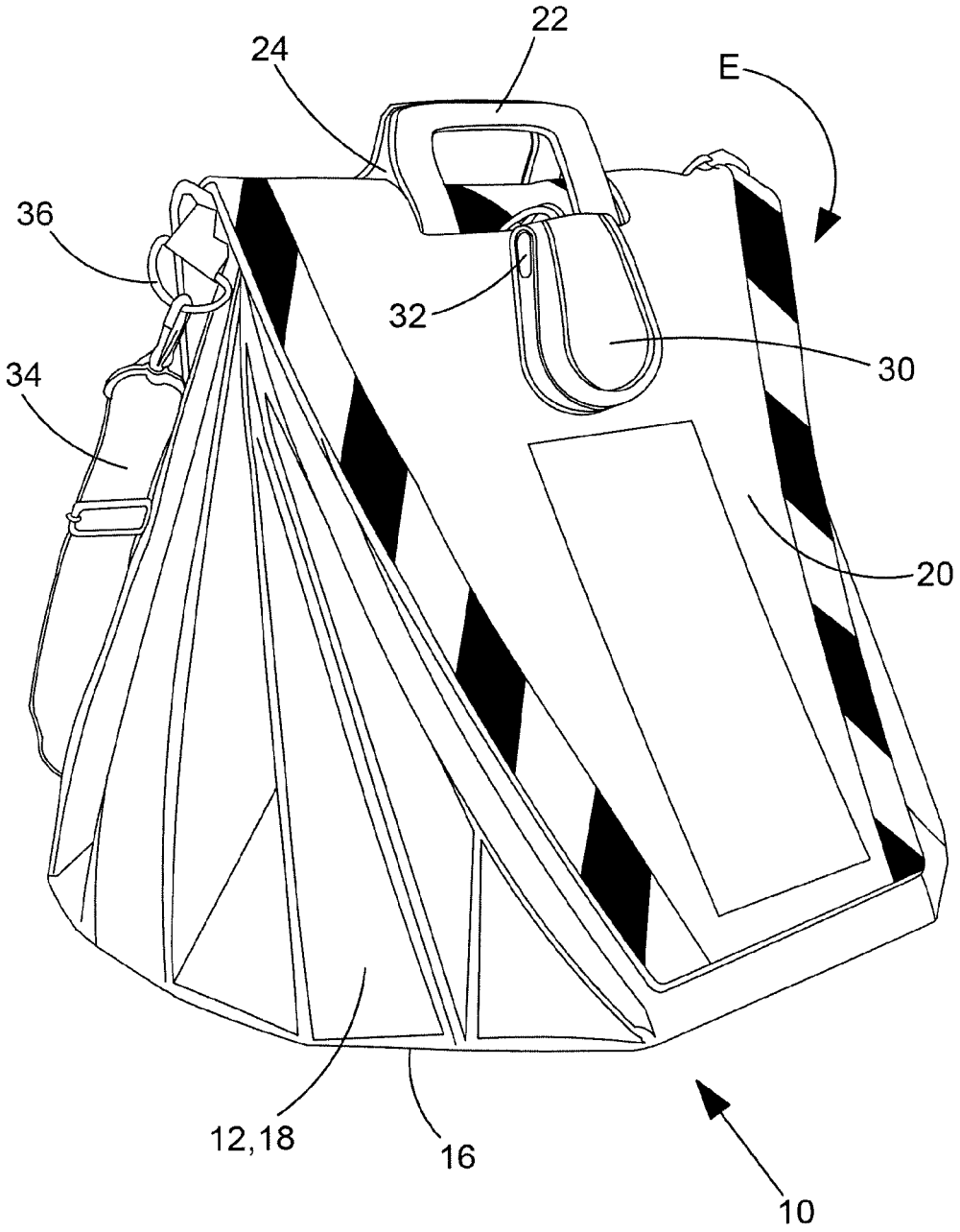
FIG. 6 is a perspective view of the mat folded in a bag configuration.
Figure 7:
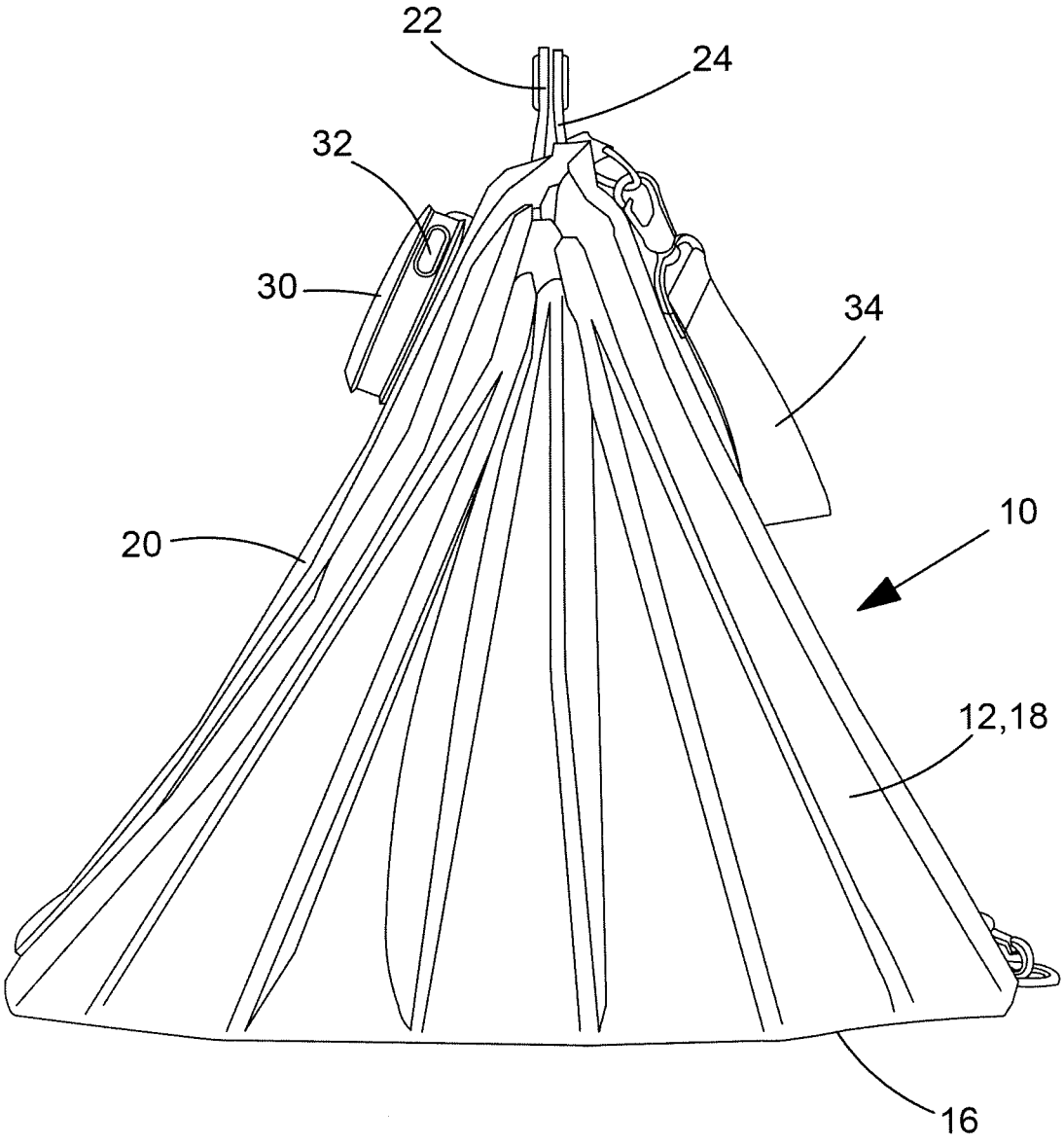
FIG. 7 is a side view of the mat.

The present invention relates to a portable work space comprising a work mat 10 convertible between a mat configuration, as is shown in FIGS. 1 to 4 and 9 to 11, and a bag configuration, as is shown in FIGS. 6 and 7.

Referring to FIGS. 1 to 4, there is shown an embodiment of the mat 10 unfolded into the mat configuration. The mat 10 comprises a body 12 made of layers of materials, as is described in more detail below.

The body has a top face 120 and a bottom face 122. In normal use, the bottom face 122 contacts the ground or a flat surface and the top face 120 is for supporting a user, storage of tools and accessories and collecting lose parts and debris.

The body 12 has a body peripheral edge 14 with a general polygonal shape, as is shown in FIGS. 1 to 4, although the peripheral edge 14 may have a generally circular shape or a shape combining curved and straight portions.

The body 12 has a central portion 16 and an outer peripheral portion 18 surrounding the central portion 16. The body 12 comprises a cover 20 hingedly connected to the body 12 near, or at, the peripheral edge 14 and a pair of handles 22, 24 each connected to the body 12 near, or at, the peripheral edge 14 on diametrically opposite sides of the body 12.

The peripheral edge 14 comprises a straight front edge 140 and a straight rear edge 142 arranged on a diametrically opposite side of the body 12 to the front edge 140. One handle 22 and the cover 20 are connected to the peripheral edge 14 near, or at, the front edge 140. The other handle 24 is connected to the peripheral edge 14 near, or at, the rear edge 142. In all, the peripheral edge 14 comprises eight straight long edges 140, 142, 144 amongst which the front 140 and rear 142 edges are included. The peripheral edge 140 comprises four straight short edges 146. The peripheral edge 14 would have an approximately octagon shape (i.e. regular two dimensional eight sided polygon) were it not for the fact that a short edge 146 is arranged in between each of the front 140 and rear 140 edges and the three long edges 144 on each side of the peripheral edge 14.

An foldable central seam 160 in the body 12 surrounds the central portion 16 and defines a junction, or weakened region, between the outside of central portion 16 and inside of the peripheral portion 18. The central seam 160 has a generally annular, or lozenge, shape with a combination of curved and straight portions. The peripheral edge 14 defines the outside of the peripheral portion 18.

The body 12 comprises an array of foldable side seams 180 in the peripheral portion 18. Each side seam 180 extends in a straight, approximately radial, line or weakened region, between the central seam 160 and the peripheral edge 14. Side seams 180 divide the peripheral portion 18 into a web of alternating major 182 and minor 184 isosceles triangle panels, except where the peripheral portion is bounded by the front 140 and rear 140 edges. The peripheral portion 18 comprises sixteen major isosceles triangle panels 182 and fourteen minor isosceles triangle panels 184. Side seams 180 divide the peripheral portion 18 into an isosceles trapezium panel 186 at each of the locations where the peripheral portion 180 is bounded by the front 140 and rear 140 edges.

Short sides of the major isosceles triangle panels 182 are arranged at the peripheral edge 14. Short sides of the minor isosceles triangle panels 184 are arranged at the central seam 160. Each long straight edge 144 is formed by short sides of two major isosceles triangle panels 182. Each short straight edge 146 is formed by the short side of one major isosceles triangle panel 182. The longest side of each isosceles trapezium panel 186 is arranged at the peripheral edge 14.

The body 12 comprises a gathering means 26 to control raising the peripheral portion 18 and folding it from the mat configuration to the bag configuration and, conversely, to control dropping the peripheral portion 18 and unfolding it from the bag configuration to the mat configuration. The gathering means 26 comprises a length of cord 28 and an adjustable locking mechanism 30. One end of the cord 28 is fixed to the locking mechanism 30. From there, the cord 28 is threaded through a series of eyelets 188 in the body 12 arranged around the peripheral edge 14. The eyelets 188 are equidistantly spaced from the central seam 180. The other end of the cord 28 is wound upon an internal reel (not shown) in the locking mechanism 30. The internal reel is biased wind the cord 28 inside the locking mechanism 30 and, in doing so, raise the peripheral portion 18. Operation of the internal reel may be suspended by a user-operable lock 32 which may be used to grip the cord 28 and, in doing so, lock its movement in relation to the locking mechanism 30.

The eyelets 188 are arranged in ten pairs. Four pairs are associated with the two isosceles trapezium panels 186 and their adjacent major isosceles triangle panels 182. The other six pairs are associated the remaining twelve major isosceles triangle panels 182.

When viewed from the top face 120 of the body 12, an anti-clockwise eyelet **188*a* of a pair of eyelets is arranged about 5 cm in an anti-clockwise direction ACW from each of the side seams 180 of the isosceles trapezium panel 186. A clockwise eyelet 188***b* of the same pair of eyelets is arranged about 5 cm in a clockwise direction CW from the same respective side seem 180 of the isosceles trapezium panel 186. The clockwise 188*a* and anti-clockwise 188*b* eyelets are arranged about 5 cm inside the peripheral edge 14.

An anti-clockwise eyelet 188*a* of a pair of eyelets is arranged about 5 cm in an anti-clockwise ACW direction from where the apex of each minor isosceles triangle panel 184 that interposes a pair of major isosceles triangle panels 182. A clockwise eyelet 188*b* of the same pair of eyelets is arranged about 5 cm in an clockwise direction CW from the apex of the same respective minor isosceles triangle panel 184 that interposes the same pair of major isosceles triangle panels 182. The clockwise 188*a* and anti-clockwise 188*b* eyelets are arranged about 5 cm inside the peripheral edge 14.

The cover 20 comprises an inner panel 202 and an outer panel 204 of at least semi-rigid material, as is described in more detail below. The inner 202 and outer 204 panels have approximately the same outer shape as the isosceles trapezium panels 186. As mentioned above, the longest side of the inner panel 202 hingedly connected to the front edge 140. The cover 20 comprises a hinge 206 and a bar 208. The inner panel 202 and the outer panel 204 are joined together by the hinge 206 along their shortest sides. The hinge 206 allows the outer panel 204 to pivot a short way from the inner panel 202 as indicated by double-headed arrow A. The bar 208 is connectable between the inner panel 202 and the outer panel 204 in the manner of an A-frame.

The inner panel 202 and the outer panel 204 adopt a divergent orientation with respect to each other and from the hinge 206. The longest sides of the inner panel 202 and the outer panel 204 each have a pair of feet 202*a*, 202*b*, 204*a*, 204*b*. When the inner panel 202 and the outer panel 204 stand up, the feet 202*a*, 202*b*, 204*a*, 204*b* define a footprint of the cover 20 on the ground or the surface upon which the mat 10 is located. In this orientation, the inner panel 202 and the outer panel 204 stand up so that the cover 20 may protrude proud of the planar top face 120 of the mat 10. Friction between the ground and the feet 202*a*, 202*b*, 204*a*, 204*b* is sufficient to stand up the inner panel 202 and the outer panel 204. The bar 208 connected between the inner panel 202 and the outer panel 204 helps to steady the inner panel 202 and the outer panel 204 with respect to each other and ensure that they remain standing. The footprint of the cover 20 falls outside the work surface provided by the mat 10 leaving the work surface free to for use.

The inner panel 202 and/or the outer panel 204 may be brightly colored and/or have notices 210 to attract the attention of users around the mat 10 and the work surface provided by the mat 10.

Optionally, the peripheral edge 14 may be brightly colored with high visibility, reflective and/or fluorescent marking to help demarcate and organize the work surface provided by the mat 10.

Figure 5:
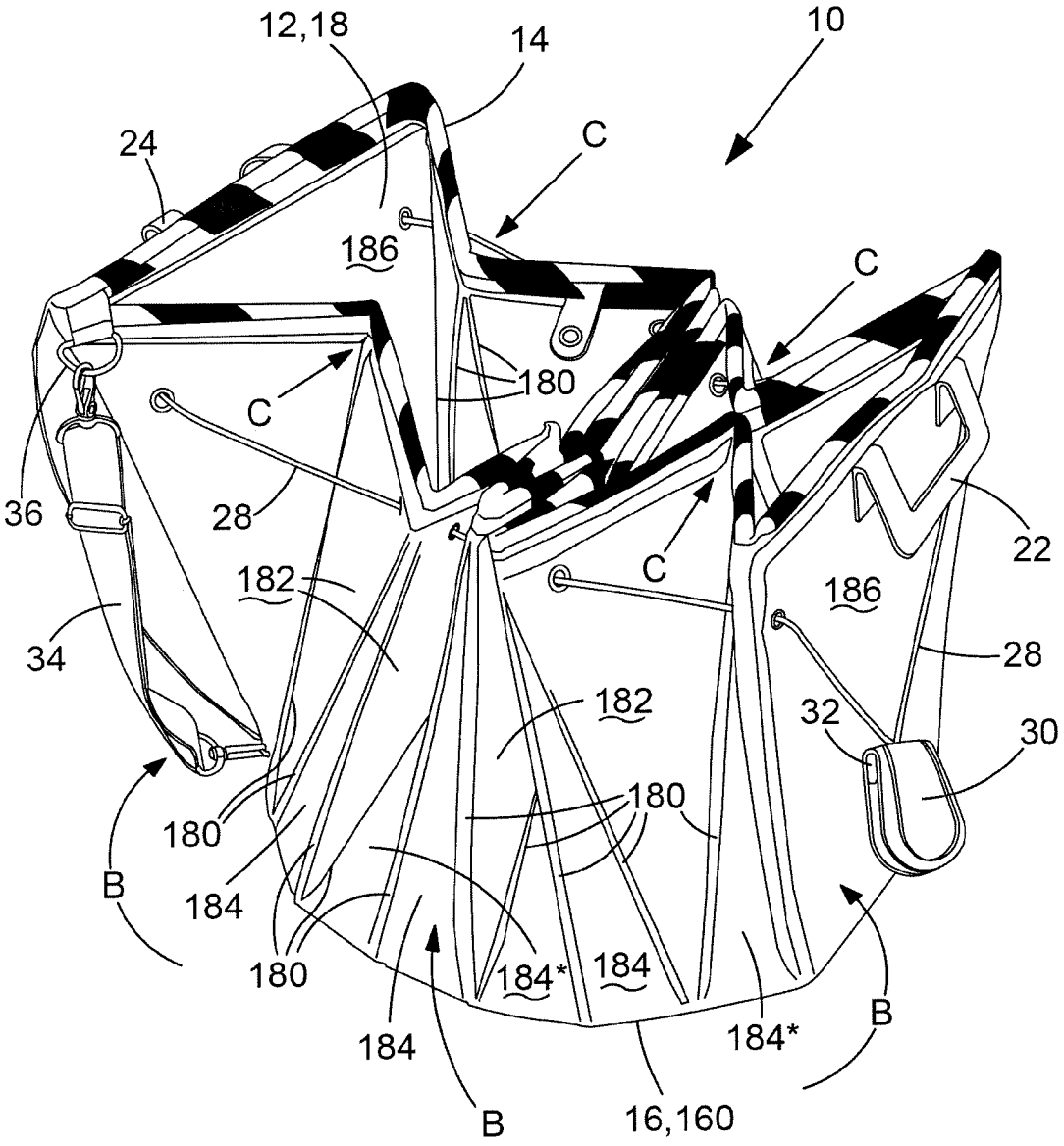
FIG. 5 is a perspective view of the mat partially unfolded between a bag configuration and a mat configuration.

Referring to FIG. 5, there is shown the convertible mat 10 which is folded midway between the mat configuration and the bag configuration. The folding process is started when a user operates gathering means 26 by locking the cord 28 to the locking mechanism 30 by actuating the lock 32. The user holds mat 10. The user pulls the gathering means 26 and the cord 28 away from the mat 10 to draw the peripheral portion 18 upward in the direction of arrow B. The peripheral portion 18 folds with respect to the central portion 16 around the central seam 160. At the same time, the peripheral portion 18 folds along the side seams 180 in the manner of concertina fold. The eyelets 188 are automatically drawn towards each other on the outside of the mat 10 in the bag configuration. This causes the apex of those minor isosceles triangle panels 184* not straddled by eyelets 188*a*, 188*b* to be automatically drawn, in the direction of arrow C, towards the inside of the mat 10 in the bag configuration.

Figure 1:
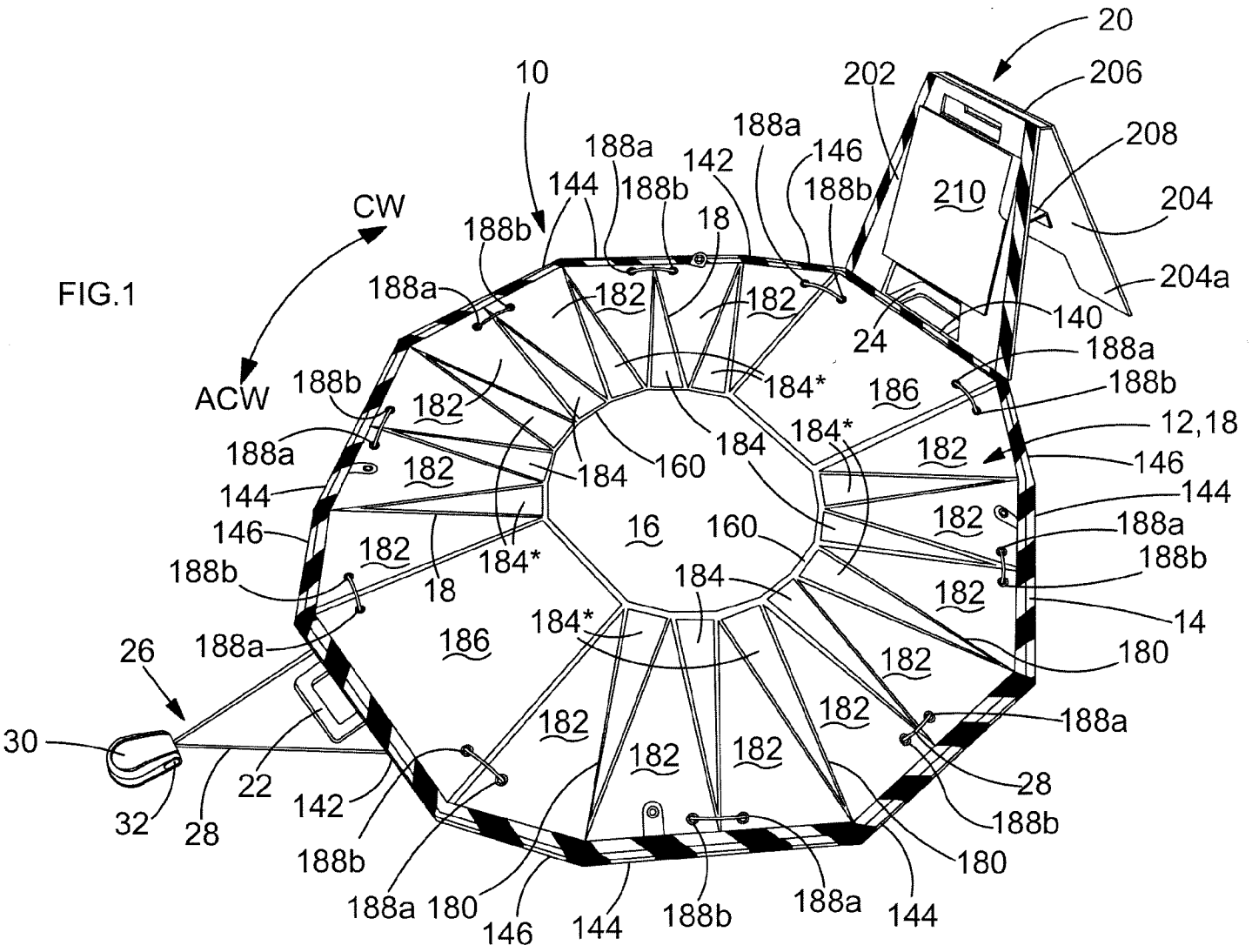
FIG. 1 is a perspective view of a portable work surface comprising a work mat unfolded in a mat configuration.
Figure 2:
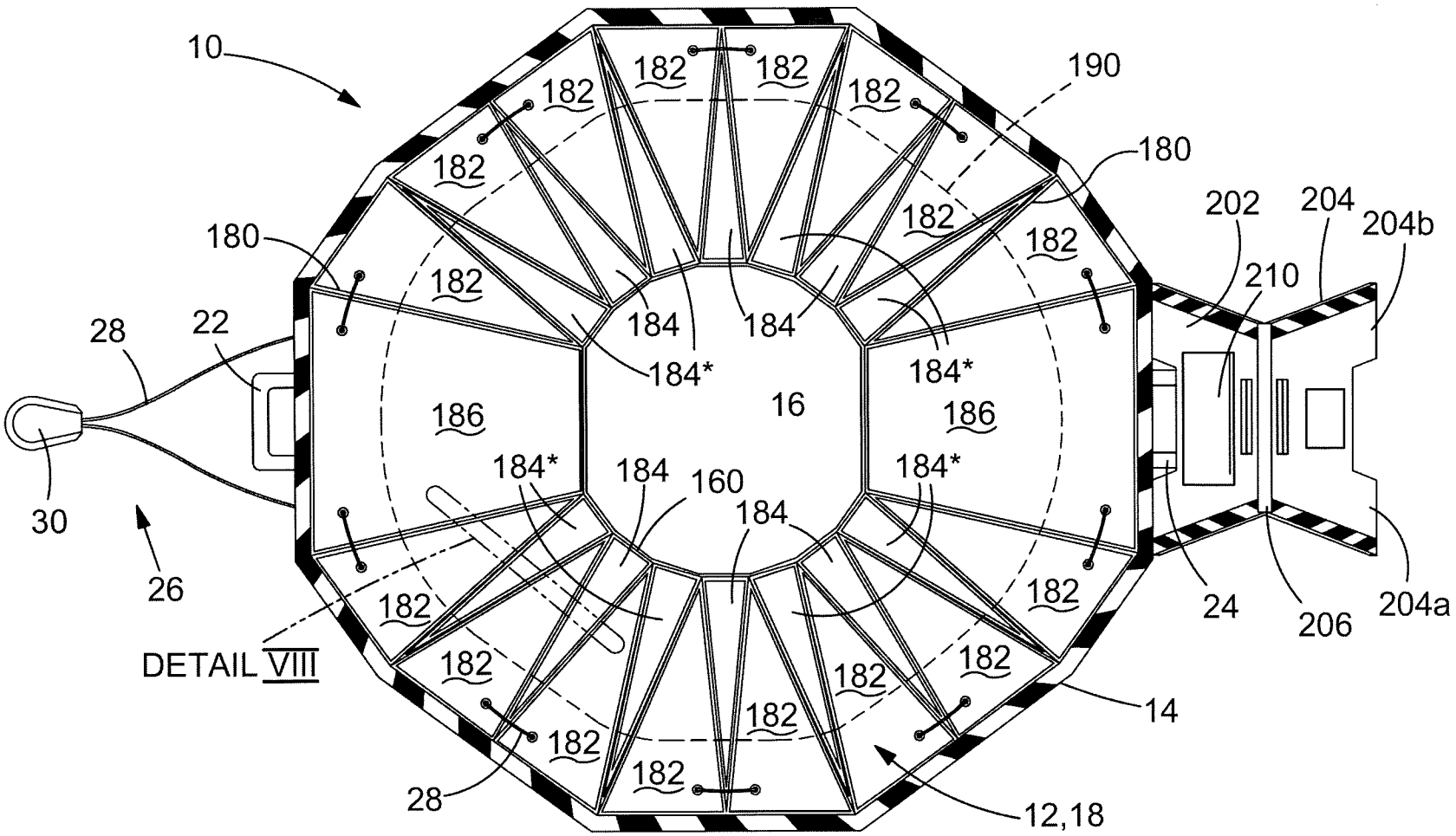
FIG. 2 is a plan view of the mat unfolded in a mat configuration.
Figure 3:
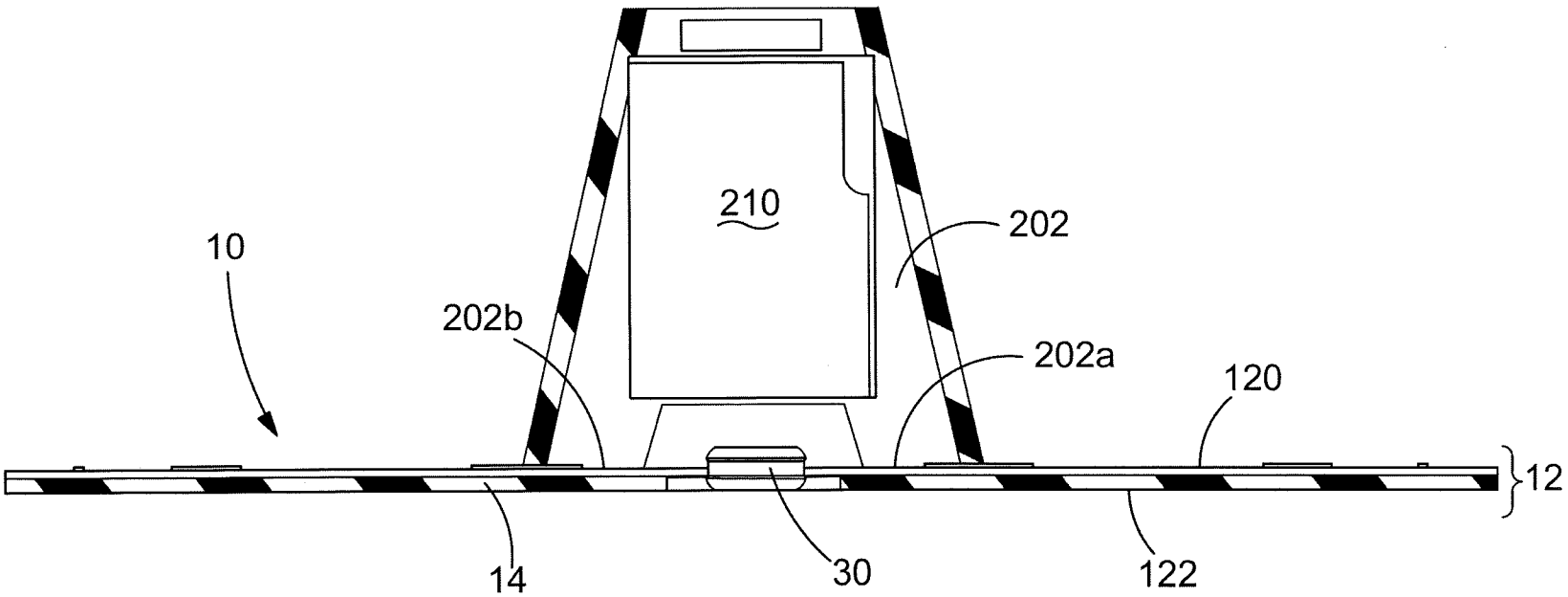
FIG. 3 is an end view of the mat unfolded in a mat configuration.
Figure 4:
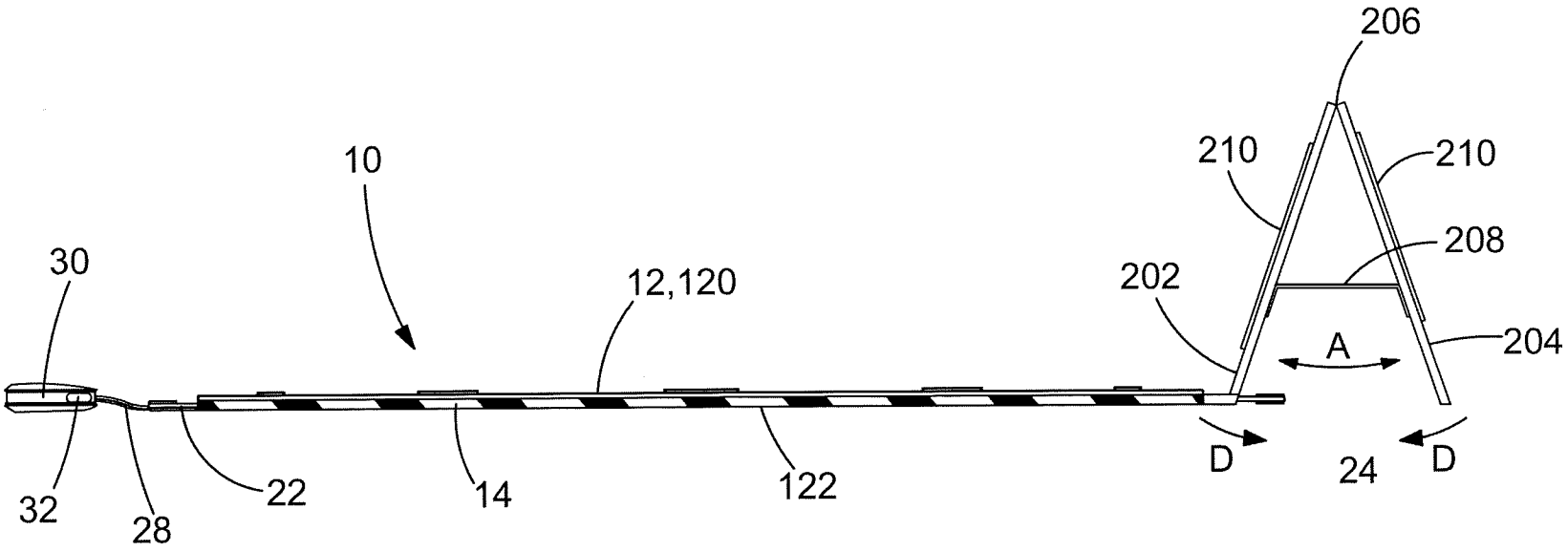
FIG. 4 is a side elevation view of the mat unfolded in a mat configuration.

Referring to FIGS. 6 and 7, the user may continue to pull the gathering means 26 until the front 140 and rear 142 edges of the peripheral edge 14 meet and the long 144 and short 146 straight edges are folded therebetween. In this position, the handles 22, 24 are aligned with each other and the mat 10 is in a free-standing bag configuration. The central portion 16 defines a bag base and the peripheral portion 18 a bag wall which maintains a substantially upright orientation. The user operates the lock 32 to release its grip of the cord 28. The internal reel of the locking mechanism 30 automatically winds the cord 28 inside the locking mechanism 30 and, in doing so, takes up slack in the cord 28. The user may operate the lock 32 to re-grip the cord 28. The user releases, or has already released, the bar 208 from between the inner 202 and the outer 204 panels and pivots them together (in the direction of arrows D as is shown in FIG. 4) so that the inner 202 and the outer 204 panels unite to form the cover 20. The user folds the cover 20 over the front 140 and rear 142 edges, in the direction of arrow E, so that the cover 20 straddles the front 140 and rear 142 edges. Gaps between the feet 202*a*, 202*b* of the inner panel 202 and the feet 204*a*, 204*b* of the outer panel 204 provide clearance for the handles 22, 24 as the cover 20 pivots over them. The user clips the lockable locking mechanism 30 to the cover 20 or, optionally, stows it inside the mat 10 in its bag configuration. The cover 20 is releasably fastened to the outside of the peripheral portion 18 using a hook and look fastening system, or the like.

The handles 22, 24 come together to be grasped by a user when the mat 10 in its bag configuration. This, in addition to the cover 20, helps to keep the peripheral edge 14 closed. The mat 10 comprises a shoulder strap 34 which is fastened to rings 36, 38 on opposite sides of where the cover 20 is connected to the peripheral portion 18. The strap 34 may be used to carry the mat 10 in its bag configuration.

Figure 8:
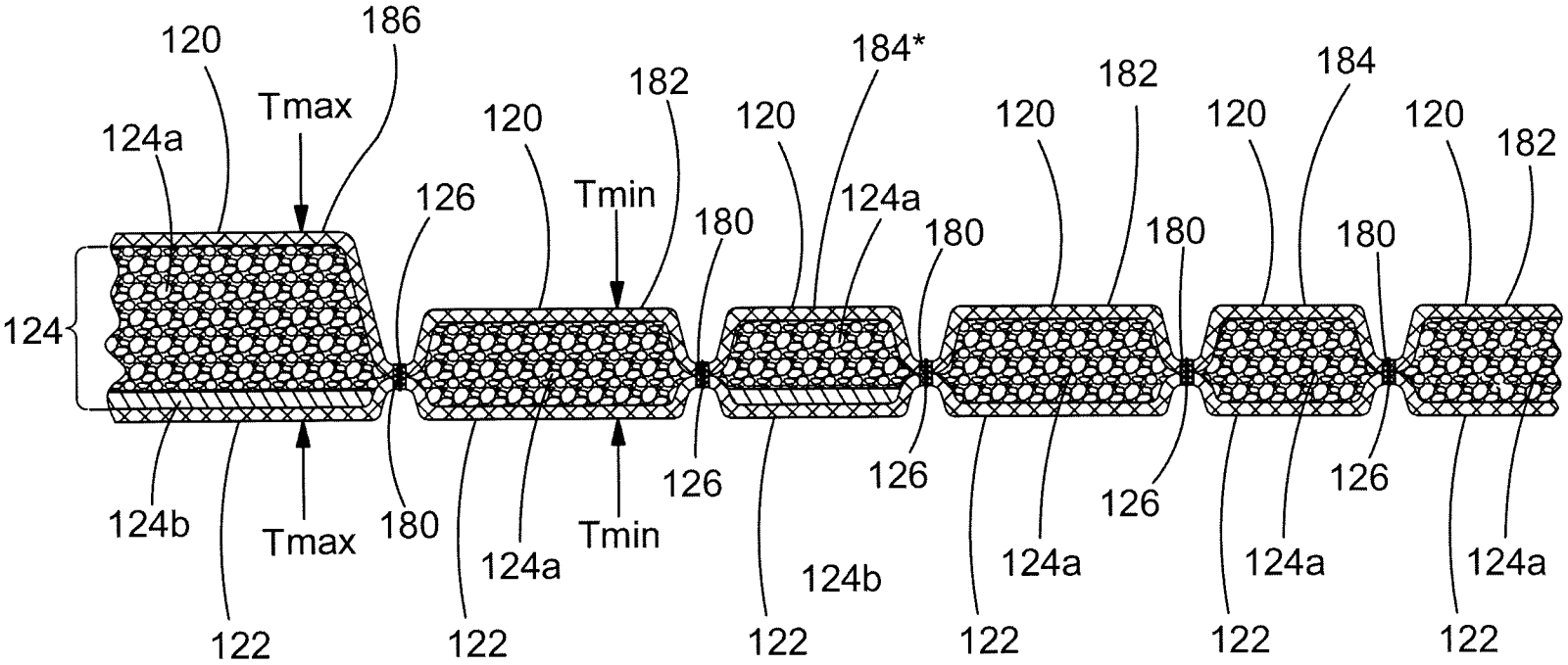
FIG. 8 is a cross-sectional view of detail VIII of the material of the mat in FIG. 2.

Referring to FIG. 8, the body 12 comprises the top face 120 and the bottom face 122. Except for where the foldable central 160 and side 180 seems are located, the body 12 comprises a middle layer 124 between the top face 120 and the bottom face 122.

The top face 120 and the bottom face 122 are made of flexible and durable woven fabric material like, for example, polyester or polyamide. The woven fabric material may have a fiber mass density of around 500 dernier material or more. The woven fabric material of the top face 120 and/or the bottom face 122 may be coated, or laminated, with a layer of polyvinyl chloride (PVC) to help make it water-proof or water-resistant. The woven fabric material of the top face 120 and/or the bottom face 122 may be treated to make it flame retardant, electrically dissipative or electrically conductive. If the woven fabric material of the top face 120 and/or the bottom face 122 is electrically conductive it may be grounded with an electrical connection to avoid electrostatic discharge caused by the passage of peoples' shoes or conductive objects. The woven fabric material of the top face 120 and/or the bottom face 122 may be textured for grip or embedded with instructions or pictograms. The top face 120 and the bottom face 122 may each have a thickness of about 1 mm to 4 mm.

The middle layer 124 comprises a resilient layer 124*a* of cushioning foam material like, for example, synthetic rubber such as acrylonitrile butadiene rubber or nitrile butadiene rubber. The resilient layer 124*a* is durable, viscoelastic material which is impact absorbent so that it may disperse loads to reduce impact by as much as five times the weight of an impacting force. The resilient layer 124*a* may be treated to make it flame retardant, electrically dissipative or electrically conductive.

The middle layer 124 of those minor isosceles triangle panels 184* with an apex that is not straddled by pairs of eyelets 188*a*, 188*b* and the middle layer 124 of the isosceles trapezium panels 186 comprises (in addition to a resilient layer 124*a*) a rigid layer 124*b* of relatively lightweight rigid plastics material. The rigid layer 124*b* may be any material that is light enough to be a component of a bag.

The term rigid when used in respect of the rigid layer 124*b* is intended to mean that it is relatively rigid in comparison to those components of the body 12 that are intended to flex, like, for example, the top face 120, the bottom face 122 and the resilient layer 124*a*. The rigid layers 124*b* are sufficiently rigid to hold the peripheral portion 18 in an upright position as is shown in FIGS. 5 to 7 when the mat 10 is in the bag configuration, in FIG. 9 when the peripheral portion 18 is against a wall W, in FIG. 10 when the peripheral portion 18 acts as a scoop or in FIGS. 1, 3 and 4 when the cover 20 is stood upright.

Although not shown in FIG. 8, the middle layer 124 may comprise additional components, like, for example, a sensor layer or pressure pads which can detect the presence or absence of an object or a person on the mat 10. The sensor layer or sensor pads may be in communication with nearby equipment or tools in order to control them depending on what is detected on the mat 10.

Parts of the body 12, such as the major 182 and minor 184,184* isosceles triangle panels, have a cross-sectional thickness Tmin of about 6 mm to 8 mm. Other parts of the body 12, such as the isosceles trapezium panels 186 and/or the central portion 16 have additional resilient layer 124*a* material and a cross-sectional thickness Tmax of about 10 mm to 16 mm. The additional resilient layer 124*a* material provides cushioning for a user sat, or kneeling, upon the mat 10.

Optionally, only those portions of the isosceles trapezium panels 186 and the major isosceles triangle panels 182 located outside an annular ridge 190 (shown as an annular ghost line 190 around the peripheral portion 18) have a cross-sectional thickness Tmax. The difference in cross-sectional thickness between the body 12 on the inside (Tmin) and the outside (Tmax) of the annual ridge 190 forms a sunken zone which helps to collect and retain lose parts and debris fallen on the mat 10.

The foldable central 160 and side 180 seems are formed by thermo-welded, or molded, joints between the materials of the top face 120 and the bottom face 122. The narrowed cross-sectional thickness of the central 160 and side 180 seems in relation to both the cross-sectional thicknesses Tmax and Tmin is what predisposes the central 160 and side 180 seems to folding. After the thermo-welded joint has been formed, the central 160 and side 180 seems may be reinforced with stitched fibers 126. The stitching process, if undertaken, comes after the thermo-welding process so as to seal the middle layer 124 from the holes caused by stitchwork.

The location of middle layers 124 with resilient 124*a* and rigid 124*b* layer components is adapted to promote folding and unfolding of the mat 10 in a certain manner. The middle layer 124 of the body's central portion 16 comprises (in addition to a resilient layer 124*a*) a rigid layer 124*b* which promotes folding of the peripheral portion 18 around the central portion 16. Likewise, the middle layer 124 of the body's isosceles trapezium panels 186 comprises (in addition to a resilient layer 124*a*) a rigid layer 124*b* to help cluster the major 182 and minor 184 isosceles triangle panels between the isosceles trapezium panels 186 as they approach each other during folding.

Figure 9:
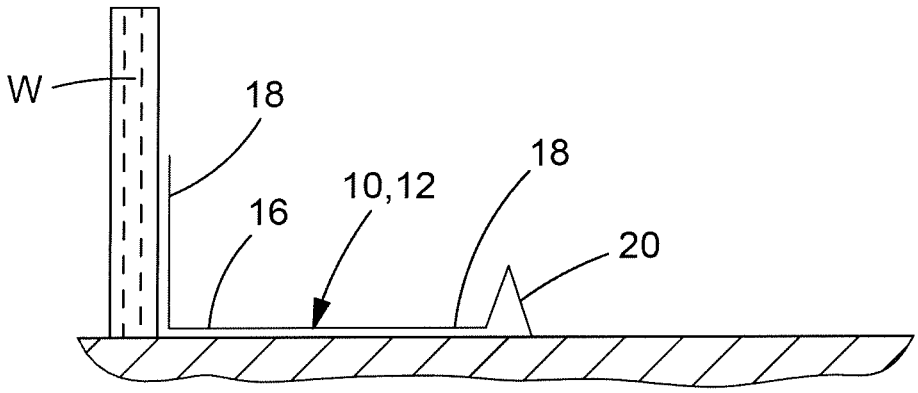
FIG. 9 is a schematic view of the mat partially unfolded against a wall.
Figure 10:
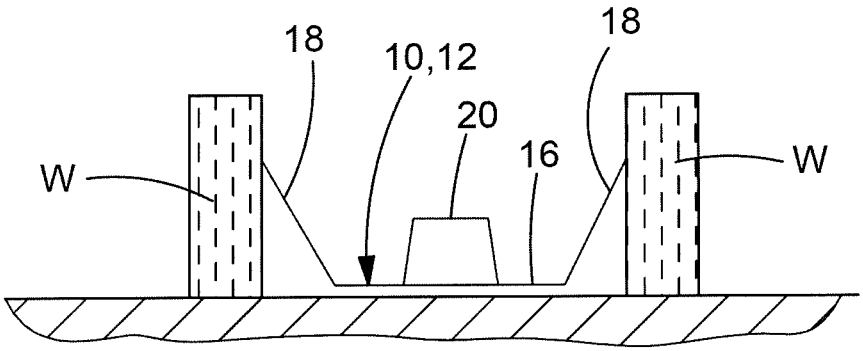
FIG. 10 is a schematic view of the mat partially unfolded between two walls.

Referring particularly to those minor isosceles triangle panels 184* with an apex that is not straddled by pairs of eyelets 188*a*, 188*b*, the middle layer 124 of these minor isosceles triangle panels 184* comprises (in addition to a resilient layer 124*a*) a rigid layer 124*b*. This provides a reinforced spine about which adjacent major isosceles triangle panels 182 tend to fold and, as a result, move in the direction of arrow C to the inside of the mat 10 in the bag configuration. The minor isosceles triangle panels 184* and the isosceles trapezium panels 184, 186 provide rigidity spanning the peripheral region 18 between the central seam 160 and the peripheral edge 14. This rigidity keeps the peripheral portion 18 upright as the mat 10 is gathered by the gathering means 26 midway between the mat configuration and the bag configuration, as is shown in FIGS. 5, 9 and 10. Preferably, each rigid member comprises a substantially straight edge adjacent the central portion. The short side of each minor isosceles triangle panels 184* forms a substantially straight edge to the central seam 160 which is adjacent the central portion 16. These straight edges help to steady the minor isosceles triangle panels 184* on the ground when the peripheral portion 18 is folded, or partially folded, into the bag configuration.

The inner 202 and outer 204 panels of the cover 20 may comprise the same materials as the body 12 i.e. the top face 120, the bottom face 122 and the middle layer 124. The materials chosen for the middle layer 124 are sufficiently rigid to stand the inner 202 and outer 204 panels in an upright orientation which is proud of the planar mat configuration of the mat 10. The cover 20 may be integral with the body 12 along the straight front edge 140 of the peripheral edge 14 or it may be joined there by a thermo-welded joint or a stitched joint, or the like. The hinge 206 may be integral with the inner 202 and outer 204 panels or it may be joined by a thermo-welded joint or a stitched joint, or the like. The join between the inner panel 202 and the straight front edge 140 and the hinge 206 between the inner 202 and outer 204 panels 20 each define a junction, or weakened region, which is predisposed to folding.

Returning to FIGS. 1 to 7, unfolding of the mat 10 from a bag configuration to a mat configuration is a reverse of the folding of the mat 10. Folding or unfolding may be done within a matter of seconds.

In use as a bag, the mat 10 is for carrying tools and consumable parts around a work site. Inside, the top face 120 of the body 12 may be equipped with a transparent "briefcase" pocket for containing written instructions. The top face 120 may have other straps or pouches for storing tools, consumable parts and debris. The top face 120 may have hook and loop fastener pads for connection of additional pouches etc. The top face 120 may have additional eyelets to connect tethered tools (i.e. tools having an umbilical cord).

In use as a mat, the mat 10 is normally opened on a generally flat ground or surface. To perform this function, the mat 10 may be flattened, with help from a user's hands while the gathering means 26 is operated so that cord 28 may be unwound from the adjustable locking mechanism 30.

Since the mat 10 is foldable, it may also be partially rested up against a wall or obstacle, or over an obstacle, if this is required due to lack of space or an irregular work environment. To perform this function, the mat 10 may be deliberately partially folded, by operation of the gathering means 26, so that a part of the peripheral portion 18 is raised up by the cord 28. In this way, the peripheral portion may behave as a ramp, or scoop, to recuperate and collect lose parts and debris.

The work surface provided by the mat 10 has a diameter of between 1 m and 2 m depending on the diameter of the body 12. The work surface boundary is defined by the peripheral edge 14. The cover 20 may be converted into an upstanding A-frame panel 202, 204 with bright colors and/or notices 210 to attract the attention of people in the vicinity. The mat 10 acts as a receptacle of fallen tools, accessories, lose parts and other debris while the user is at work. Resilient materials in the body 12 of the mat 10 protect the knees of a user and improve comfort when a user is supported by the mat 10.

When the work is complete, the user converts the mat 10 back into a bag and departs confident in the knowledge that the tools, accessories, lose parts used and the debris generated have been recovered and the work site is clean. Recovery and transportation of these tools, accessories, lose parts and other debris away from maintenance and repair environments helps to avoid damage and contamination of the moving machinery. This is called foreign object damage (FOD). Equipment that helps to avoid FOD is highly valued, particularly in industrial or maintenance environments. The tools, accessories, lose parts and other debris recovered by the mat 10 can be stored and/or disposed away from the work site and this helps to avoid FOD incidents. Also, it allows a user to stop work and pack away what is effectively a portable work surface and transport the mat 10, in bag configuration, to somewhere where storage and disposal may be done more conveniently, such as in a store room or a waste disposal facility. This type of equipment allows the user to work more efficiently and it saves time, particularly if the user may avoid returning to the original place of work in search of missing items.

Figure 11:
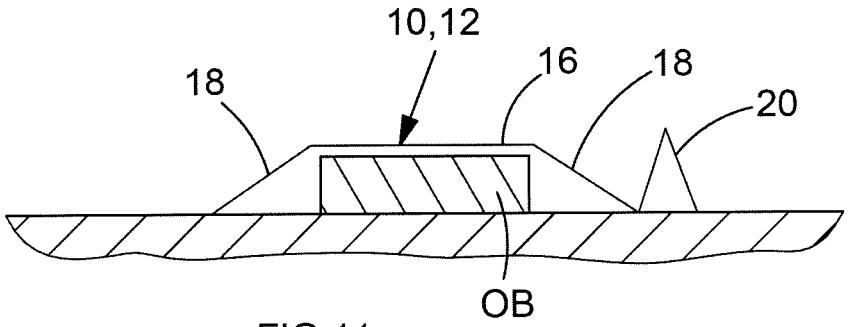
FIG. 11 is a schematic view of the mat unfolded over an obstacle.

As mentioned above, the mat 10 may be partially rested up against a wall or obstacle, or over an obstacle, if this is required due to lack of space or an irregular work environment. Referring to FIGS. 9 to 11, there is shown the mat 10 in use in such irregular work environments.

Referring in particular to FIG. 9, part of the peripheral portion 18 is raised by 90 degrees against a wall W. In this configuration, the peripheral portion 18 provides a vertical barrier between the user and a wall W. Referring in particular to FIG. 10, two sides of the peripheral portion 18 are inclined by about 45 degrees between two walls W. In this configuration, the peripheral portion 18 provides a ramp, or scoop, which helps to recuperate and collect lose parts and debris. Referring to FIG. 11, the peripheral portion 18 is inclined in a reverse direction to cover, or obscure, an obstacle OB under the mat 10. The inner panel 202 and the outer panel 204 are stood so that the cover 20 may provide a warning to users in the vicinity of the mat 10.

The invention claimed is:

1. A portable work surface comprising a work mat convertible between a mat configuration and a bag configuration, the mat comprising:

a body with a central portion and a peripheral portion surrounding the central portion;

a cover hingedly connected to the body;

a cord threaded at least part way around the peripheral portion;

wherein the central portion and the peripheral portion are configurable to define a substantially planar mat configuration;

wherein the peripheral portion is foldable about the central portion;

wherein the cord is operable to fold the peripheral portion about the central portion to define a bag configuration;

wherein the cover is foldable to straddle the peripheral portion in the bag configuration;

wherein the cover is configurable to protrude proud of the planar mat configuration of the central portion and the peripheral portion; and wherein the cover comprises an inner panel and an outer panel hingedly connected to the inner panel and wherein the outer panel is pivotable to adopt a divergent orientation with respect to the inner panel whereat the outer panel is arranged to support the cover proud of the planar mat configuration of the central portion and the peripheral portion.

2. The portable work surface as claimed in claim 1, wherein the cover comprises a coupling member operable to couple the outer panel in the divergent orientation with respect to the inner panel.

3. The portable work surface as claimed in claim 1, wherein the body is a substantially regular polygonal body or circular body.

4. The portable work surface as claimed in claim 1, wherein the body has an increased cross-sectional thickness around the circumference of the peripheral portion.

5. The portable work surface as claimed in claim 1, wherein the central portion comprises a rigid insert.

6. The portable work surface as claimed in claim 1, wherein the body comprises a resilient or cushioning material.

7. The portable work surface as claimed in claim 1, wherein the body comprises weakened regions arranged to facilitate folding the peripheral portion about the central portion during a transition between the mat configuration and the bag configuration.

8. The portable work surface as claimed in claim 1, wherein the body comprises a peripheral edge around the peripheral portion and wherein the cover hingedly connected to the body substantially at the peripheral edge.

9. The portable work surface as claimed in claim 1, wherein the body is a substantially regular polygonal body or circular body.

10. The portable work surface as claimed in claim 1, wherein the body has an increased cross-sectional thickness around the circumference of the peripheral portion.

11. The portable work surface as claimed in claim 1, wherein the central portion comprises a rigid insert.

12. A portable work surface as claimed in claim 11, wherein the peripheral portion comprises rigid inserts arranged to promote concertina folding of the peripheral portion about the central portion in the bag configuration.

13. The portable work surface as claimed in claim 1, wherein the body comprises weakened regions arranged to facilitate folding the peripheral portion about the central portion during a transition between the mat configuration and the bag configuration.

14. The portable work surface of claim 1, wherein in the bag configuration, the central portion defines a bag base and the peripheral portion defines a bag wall.

15. The portable work surface of claim 1, wherein the peripheral portion comprises rigid members spanning the distance of the bag wall substantially between the central portion and the cord.

16. The portable work surface of claim 15, wherein the rigid members are arranged to promote concertina folding of the rigid members about the central portion in the bag configuration.

* * * * *